US009404509B2

(12) United States Patent
Isogai

(10) Patent No.: US 9,404,509 B2
(45) Date of Patent: Aug. 2, 2016

(54) TURBOCHARGER AND METHOD OF PRODUCING THEREOF

(71) Applicant: OTICS Corporation, Nishio (JP)

(72) Inventor: Tomoyuki Isogai, Aichi (JP)

(73) Assignee: OTICS Corporation, Nishio (JP)

( * ) Notice: Subject to any disclaimer, the term of this patent is extended or adjusted under 35 U.S.C. 154(b) by 418 days.

(21) Appl. No.: 13/962,018

(22) Filed: Aug. 8, 2013

(65) Prior Publication Data

US 2014/0086726 A1 Mar. 27, 2014

(30) Foreign Application Priority Data

Sep. 21, 2012 (JP) ..... 2012-207890

(51) Int. Cl.

*F04D 29/52* (2006.01)
*F01D 25/24* (2006.01)
*F04D 25/02* (2006.01)
(Continued)

(52) U.S. Cl.

CPC ..... *F04D 29/522* (2013.01); *F01D 9/026* (2013.01); *F01D 25/24* (2013.01); *F04D 25/024* (2013.01); *F04D 29/4206* (2013.01);
(Continued)

(58) Field of Classification Search

CPC ... F04D 29/522; F04D 29/624; F04D 25/024; F04D 29/4206; F01D 25/24; F01D 9/026; Y10T 29/4924; F05D 2260/36; F05D 2230/21; F05D 2230/51; F05D 2220/40

USPC ..... 415/196, 197, 214.1, 204, 206, 212.1, 415/172.1, 203; 417/407, 83; 29/888.02, 29/888.022

See application file for complete search history.

(56) References Cited

U.S. PATENT DOCUMENTS 6,193,463 B1 2/2001 Adeff et al.
7,686,586 B2 * 3/2010 Nikpour ..... F04D 29/284 416/223 A (Continued)

FOREIGN PATENT DOCUMENTS

CN 1359452 A 7/2002
JP 2002-180841 6/2002

(Continued)

OTHER PUBLICATIONS

Combined Chinese First Notice of Reasons for Refusal and Search Report issued Aug. 14, 2015 in Patent Application No. 201310393416.X (with English language translation and English translation of categories of cited documents).

(Continued)

*Primary Examiner* — Hoang Nguyen
(74) *Attorney, Agent, or Firm* — Oblon, McClelland, Maier & Neustadt, L.L.P.

(57) ABSTRACT

A turbocharger includes a compressor housing, a bearing housing and a back plate. A discharge scroll chamber has such a shape that a cross-sectional area thereof gradually increases toward a discharge port in a circumferential direction. The compressor housing includes a scroll piece assembled to a shroud piece. The scroll piece includes a suction port-forming portion, a suction-side concave surface and a scroll outer periphery. The shroud piece includes a shroud fit-in portion, an inner peripheral concave surface, a shroud surface and a diffuser surface. The back plate includes a facing surface, an outer peripheral annular fit-in portion and an outer peripheral concave surface. The outer peripheral concave surface has such a shape that a cross sectional shape thereof formed by a plane including a rotation axis of an impeller gradually changes in the circumferential direction.

6 Claims, 13 Drawing Sheets

(51) Int. Cl.

| | |
|---|---|
| ***F04D 29/42*** | (2006.01) |
| ***F04D 29/62*** | (2006.01) |
| ***F01D 9/02*** | (2006.01) |

(52) U.S. Cl.

CPC ..... *F04D 29/624* (2013.01); *F05D 2220/40* (2013.01); *F05D 2230/21* (2013.01); *F05D 2230/51* (2013.01); *F05D 2260/36* (2013.01); *Y10T 29/4924* (2015.01)

(56) References Cited

U.S. PATENT DOCUMENTS

| | | | | |
|---|---|---|---|---|
| 8,696,310 | B2 * | 4/2014 | Dillon | F04D 29/4206 415/206 |
| 2013/0039750 | A1 * | 2/2013 | Osuka | B22C 9/24 415/204 |

FOREIGN PATENT DOCUMENTS

| | | | |
|---|---|---|---|
| JP | 2004-27931 | A | 1/2004 |
| JP | 2011-94618 | A | 5/2011 |
| JP | 4778097 | | 7/2011 |
| JP | 2011-231620 | A | 11/2011 |

OTHER PUBLICATIONS

Extended European Search Report issued Feb. 17, 2016 in Patent Application No. 13183695.9.

Office Action issued Feb. 2, 2016 in Japanese Patent Application No. 2012-207890 (with English language translation).

Office Action issued in Chinese Patent Application No. 201310393416.X dated Mar. 21, 2016 with English Translation.

* cited by examiner

TURBOCHARGER AND METHOD OF PRODUCING THEREOF

CROSS-REFERENCE

This application claims priority to Japanese patent application no. 2012-207890 filed on Sep. 21, 2012, the contents of which are entirely incorporated herein by reference.

BACKGROUND OF THE INVENTION

1. Field of the Invention

The present invention relates to a turbocharger in which a back plate is disposed between a compressor housing and a bearing housing, and the invention also relates to a method of producing the turbocharger.

2. Description of the Related Art

A turbocharger installed in a car or the like is configured such that air sucked in a compressor is compressed and discharged toward an internal combustion engine. That is, a discharge scroll chamber into which compressed air discharged from an impeller flows is formed in an air flow passage formed inside of a compressor housing, the discharge scroll chamber guides compressed air into a discharge port, and the compressed air from the discharge port is discharged toward the internal combustion engine. Especially, a shape of the discharge scroll chamber largely influences performance of the compressor, and it is required to finish the discharge scroll chamber into an appropriate shape in accordance with required performance.

Here, there is a method of producing the compressor housing by gravity die casting for example. In this case, since casting can be carried out using a so-called core, flexibility in shape is high and a complicated shape can be formed. However, since a casting cycle is long, productivity is poor and costs are high. Further, if a sand mold is used, a surface roughness becomes large and thus, there is a problem that efficiency of the compressor is deteriorated.

There is also a method of forming the compressor housing by die casting. In this case, since the casting cycle is short as compared with the gravity die casting, the productivity is superior and costs are low. However, since the compressor housing can be formed only when a molded shape can be extracted from a mold and thus, flexibility in shape is poor and a complicated shape can not be formed. Hence, there is a compressor housing formed by assembling three pieces, i.e., a scroll piece, a shroud piece and an outer peripheral annular piece as disclosed in Patent Document 1. According to this, the pieces are formed into shapes which can easily be formed by die casting, and flexibility in shape of a discharge scroll chamber of the compressor housing is secured.

In a turbocharger described in Patent Document 2, a compressor housing is composed of two pieces, i.e., a scroll piece and a shroud piece. An outer periphery of a back plate disposed on a side opposite to a suction side in the compressor housing is provided with a curved surface, and this curved surface is formed as a part of an inner wall surface of a discharge scroll chamber.

PATENT DOCUMENTS

Patent Document 1: JP 4778097 B1
Patent Document 2: JP 2002-180841 A

SUMMARY OF THE INVENTION

According to the compressor housing described in Patent Document 1, however, the number of parts is increased, producing man-hours are increased and producing costs become high. Further, if positional accuracy of the outer peripheral annular piece is not extremely high, there is a possibility that smooth flow of compressed air discharged from a diffuser portion to the discharge scroll chamber is hindered in a seam in its inner end.

In the turbocharger described in Patent Document 2, a shape of the curved surface portion formed on the back plate is constant over its circumferential direction. Hence, flexibility in shape of the discharge scroll chamber is limited, and there is a limit on an ideal shape.

The present invention has been accomplished in view of the background, and the invention provides a turbocharger capable of reducing its costs and enhancing its performance, and provides a method of producing the turbocharger.

One aspect of the invention resides in a turbocharger, including a compressor housing provided therein with an air flow passage in which an impeller is disposed;

a bearing housing rotatably supporting a rotor shaft which is connected to the impeller; and a back plate which is disposed between the bearing housing and the compressor housing and which faces a part of the air flow passage;

the air flow passage includes a suction port from which air is sucked toward the impeller, and a discharge scroll chamber which is formed on an outer peripheral side of the impeller in a circumferential direction, and which guides compressed air discharged from the impeller to a discharge port, the discharge scroll chamber has such a shape that a cross-sectional area thereof gradually increases toward the discharge port in the circumferential direction, the compressor housing includes a scroll piece and a shroud piece which are mutually assembled, the scroll piece includes a cylindrical suction port-forming portion forming the suction port, a suction-side concave surface configuring a suction-side wall surface of the discharge scroll chamber, and a scroll outer periphery disposed on an outer peripheral side of the discharge scroll chamber, the shroud piece includes a cylindrical shroud fit-in portion which is fitted into the scroll piece, an inner peripheral concave surface configuring an inner peripheral wall surface of the discharge scroll chamber, a shroud surface facing to the impeller, and a diffuser surface extending from the shroud surface toward the discharge scroll chamber, the back plate includes a facing surface which is facing to the diffuser surface, an outer peripheral annular fit-in portion which is fitted into the scroll outer periphery of the scroll piece, and an outer peripheral concave surface configuring an outer peripheral wall surface of the discharge scroll chamber, and the outer peripheral concave surface has such a shape that a cross sectional shape thereof formed by a plane including a rotation axis of the impeller gradually changes along the circumferential direction.

Another aspect of the invention resides in a method of producing the turbocharger, in which the scroll piece, the shroud piece and the back plate are individually casted, the scroll piece and the shroud piece are assembled to each other to obtain the compressor housing, the back plate is fastened to the bearing housing, and the compressor housing is assembled to the back plate to produce the turbocharger, wherein a mold for casting the back plate includes a body mold for forming the facing surface, the outer peripheral annular fit-in portion and the outer peripheral concave surface, and a central mold for forming the plate central portion, the central mold is detachably attached to the body mold, and the central mold is attached to the body mold such that a circumferential phase of the central mold is changed with respect to the body mold.

In the turbocharger, since the compressor housing can be configured using the two pieces, i.e., the scroll piece and the shroud piece, the number of parts of the compressor housing can be relatively small. As a result, the producing man-hours of the turbocharger can be reduced and the producing costs can be reduced.

Further, a part of the wall surface of the discharge scroll chamber can be formed by the outer peripheral concave surface of the back plate. That is, in a turbocharger in which a back plate is disposed between a bearing housing and a compressor housing, a part of the wall surface of a discharge scroll chamber is formed into a concave shape utilizing a part of the back plate which is an existing part. Hence, it is possible to enhance flexibility in shape of the discharge scroll chamber without increasing the number of parts.

The outer peripheral concave surface has such a shape that a cross sectional shape formed by a plane including a rotation axis of the impeller is gradually changed along a circumferential direction. Hence, a shape of a wall surface of the discharge scroll chamber on its outer peripheral side can gradually be changed along the circumferential direction. According to this, an ideal shape of the discharge scroll chamber can be obtained, and an ideal air flow in the compressor can be realized. As a result, it is possible to enhance the performance of the turbocharger.

The outer peripheral concave surface is formed in the back plate together with a facing surface thereof which is facing to the diffuser surface. Hence, a seam is not formed between the facing surface and the outer peripheral concave surface. Therefore, it is possible to easily and reliably realize a smooth flow of compressed air which is discharged from a space (diffuser portion) between the diffuser surface and the facing surface into the discharge scroll chamber. From this point of view also, it is possible to enhance the performance of the turbocharger.

In the producing method, the back plate is casted using a mold in which the central mold is detachably attached to the body mold. The central mold can be attached to the body mold such that a phase of the central mold in the circumferential direction can be changed with respect to the body mold. Hence, it is possible to produce the back plate by appropriately changing the phase of the outer peripheral concave surface with respect to the plate central portion. A phase of the plate central portion when it is assembled into the turbocharger is determined by necessity by a position of an oil discharging port. On the other hand, the phase of the outer peripheral concave surface is set in accordance with a position of the discharge port, but a position of the outer peripheral concave surface differs depending upon types of a vehicle in which the turbocharger is mounted. Hence, a phase difference between the plate central portion and the outer peripheral concave surface in the circumferential direction can differ depending upon the corresponding vehicle type. A mold for casting the back plate is configured such that the phase of the central mold in the circumferential direction can be changed and attached with respect to the body mold as described above. According to this configuration, a plurality of kinds of back plates suitable for a corresponding vehicle type can be produced using one kind of mold. Hence, according to this producing method, it is possible to produce a plurality of kinds of back plates with excellent production efficiency, and the production efficiency of the turbocharger can be enhanced.

As described above, according to the present invention, it is possible to provide a turbocharger capable of reducing its costs and enhancing its performance and to provide a method of producing the turbocharger.

DESCRIPTION OF THE PREFERRED EMBODIMENT

Figure 1:
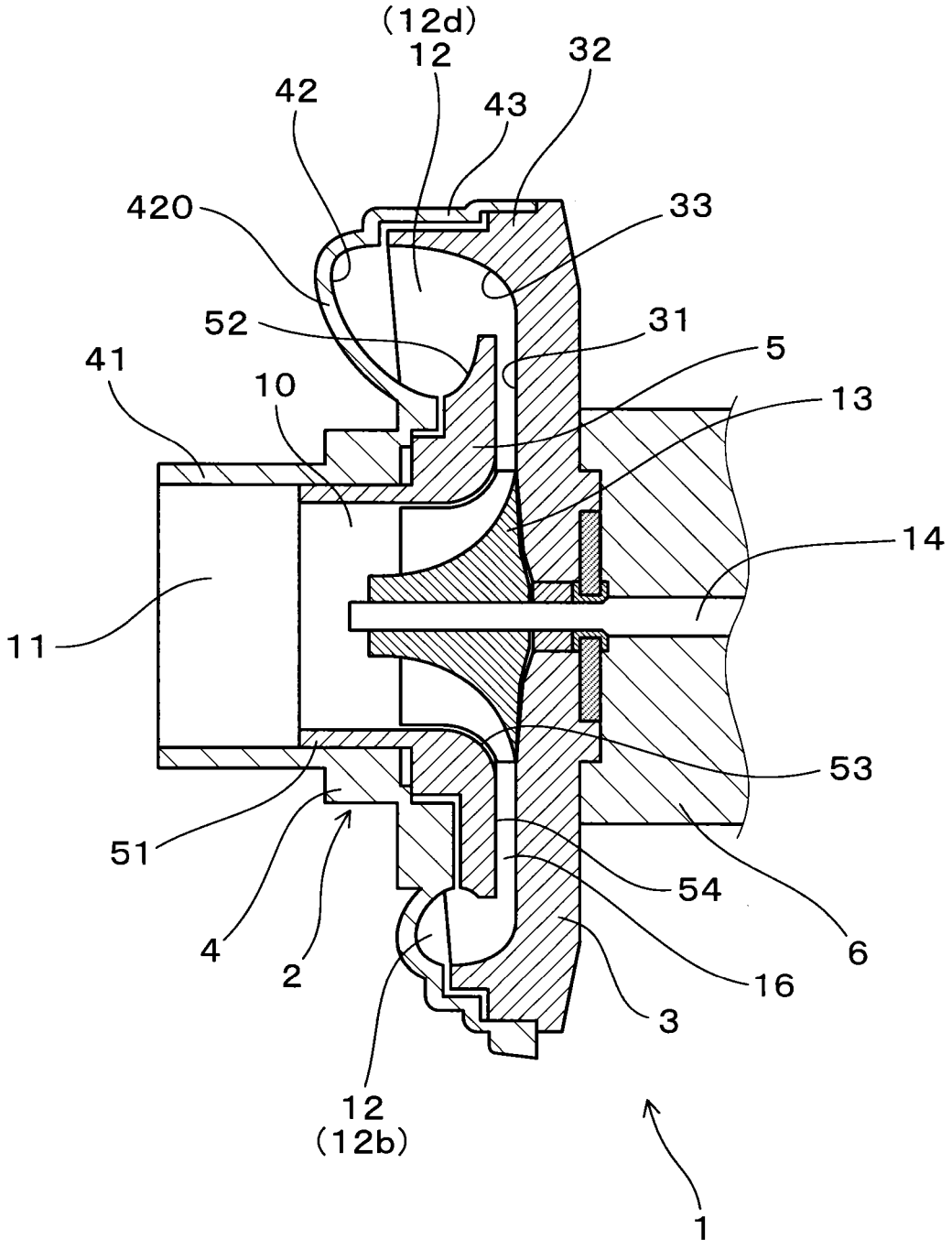
FIG. 1 is a sectional view of a compressor portion in a first embodiment taken along a line A-A in FIG. 3.

In the turbocharger, a "circumferential direction" means a rotation direction of the impeller, and an "axial direction" means a direction of a rotation axis of the impeller.

The cross sectional shape of the outer peripheral concave surface may preferably be formed such that a radius of curvature thereof gradually increases toward the discharge port in the circumferential direction. In this case, it is possible to more easily form the discharge scroll chamber into an ideal shape. That is, since the outer peripheral concave surface configuring a part of a wall surface of the discharge scroll chamber has the above-described shape, in the shape of the discharge scroll chamber in which a cross-sectional area thereof gradually becomes larger toward the discharge port in the circumferential direction, it becomes easy to form cross sections of various portions into ideal shapes. When a cross sectional shape of the outer peripheral concave surface is an arc, the radius of curvature is a radius of curvature of the arc, but the cross sectional shape of the outer peripheral concave surface is not the arc, the radius of curvature means an average radius of curvature of the entire cross sectional shape.

The outer peripheral concave surface may preferably be formed such that a size thereof in an axial direction of the turbocharger gradually increases from its one end toward the other end in the circumferential direction. In this case, like the above-described case, it is possible to more easily form the discharge scroll chamber into the ideal shape.

The outer peripheral concave surface may preferably be formed such that a size thereof in a radial direction gradually increases toward the discharge port in the circumferential direction. In this case also, like the above-described case, it is possible to more easily form the discharge scroll chamber into the ideal shape.

The back plate is fastened to the bearing housing through a bolt, a shaft hole through which the rotor shaft is inserted, a bolt hole through which the bolt is inserted and an oil discharge port through which lubricant is discharged may be formed in a plate central portion of the back plate on an inner peripheral side thereof as compared with the facing surface. In this case, when the back plate is produced, if its accuracy is enhanced, it is possible to easily assemble the turbocharger while keeping positional accuracy of the outer peripheral concave surface in the circumferential direction. That is, if the back plate is produced such that a positional relation (phase difference) in the circumferential direction between a position of the bolt hole and a shape of the outer peripheral concave surface becomes a predetermined positional relation (phase difference), a position of the outer peripheral concave surface is determined by fastening the back plate in the bolt hole through a bolt and fixing the back plate to the bearing housing. If the compressor housing is fitted to the back plate while aligning a circumferential direction thereof with the outer peripheral concave surface, the discharge port can be disposed at a position as designed, i.e., the discharge port can be disposed at a position suitable for a position of a pipe to be connected. Therefore, when the turbocharger is assembled, the discharge scroll chamber and the discharge port can easily be disposed at appropriate circumferential positions.

(First Embodiment)

A first embodiment of the turbocharger and the method of producing thereof will be described with reference to FIGS. 1 to 13.

As shown in FIG. 1, a turbocharger 1 of the first embodiment includes a compressor housing 2 provided therein with an air flow passage 10 in which an impeller 13 is disposed, a bearing housing 6 which rotatably supports a rotor shaft 14 which is connected to the impeller 13, and a back plate 3 which is disposed between the bearing housing 6 and the compressor housing 2 and which faces a part of the air flow passage 10.

Figure 3:
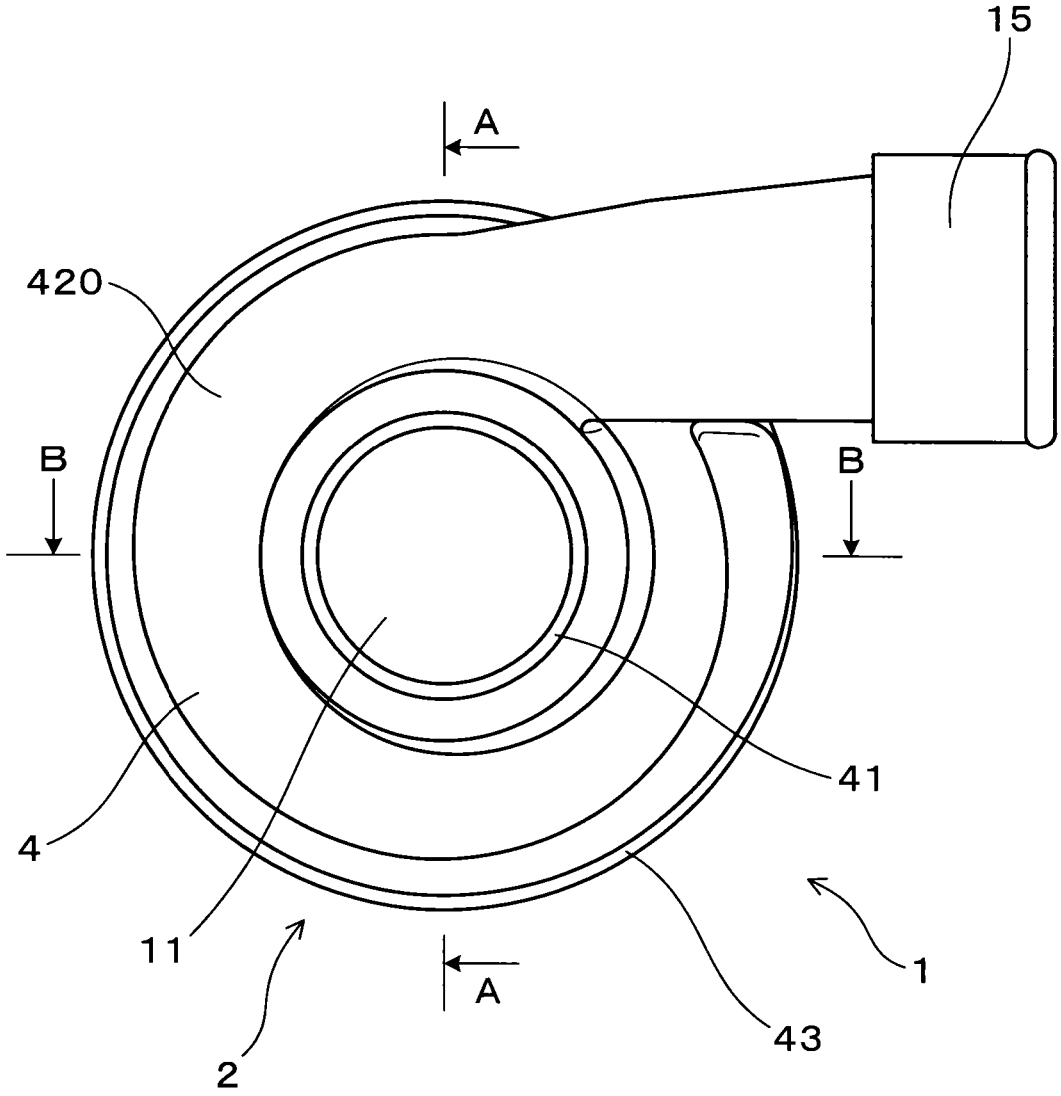
FIG. 3 is a plan view of a compressor housing in the first embodiment as viewed from a suction side.
Figure 6:
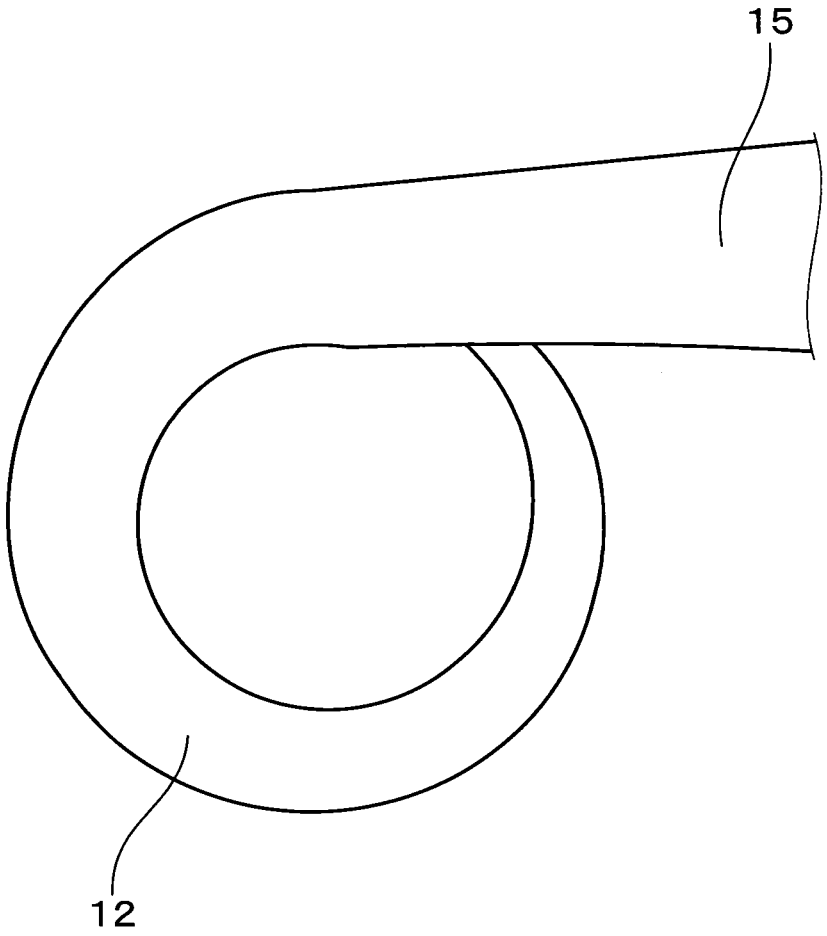
FIG. 6 is an explanatory diagram showing an entire shape of a scroll chamber in the first embodiment.

The air flow passage 10 includes a suction port 11 from which air is sucked toward the impeller 13, and a discharge scroll chamber 12 which is formed on an outer peripheral side of the impeller 13 in its circumferential direction, and which guides compressed air discharged from the impeller 13 to a discharge port 15 (see FIG. 3). As shown in FIG. 6, the discharge scroll chamber 12 has such a shape that a cross-sectional area thereof gradually increases toward the discharge port 15 in the circumferential direction.

As shown in FIGS. 1, 2, 4 and 7, the compressor housing 2 is composed of a scroll piece 4 and a shroud piece 5 which are mutually assembled.

The scroll piece 4 includes a cylindrical suction port-forming portion 41 forming the suction port 11, a suction-side concave surface 42 configuring a suction-side wall surface of the discharge scroll chamber 12, and a scroll outer periphery 43 disposed on the outer peripheral side of the discharge scroll chamber 12.

The shroud piece 5 includes a cylindrical shroud fit-in portion 51 which is fitted into the scroll piece 4, an inner peripheral concave surface 52 configuring an inner peripheral wall surface of the discharge scroll chamber 12, a shroud surface 53 facing to the impeller 13, and a diffuser surface 54 extending from the shroud surface 53 toward the discharge scroll chamber 12.

Figure 2:
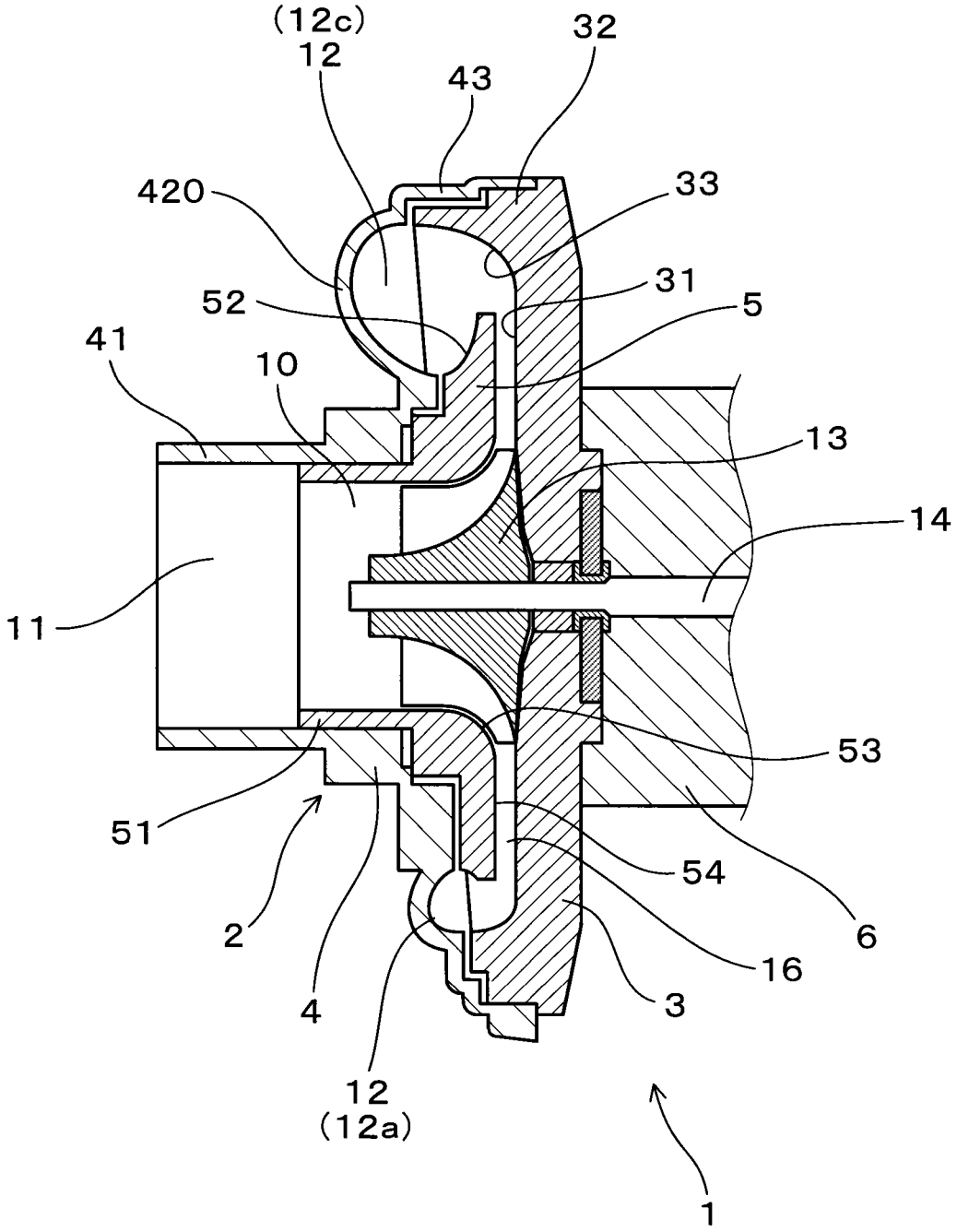
FIG. 2 is another sectional view of the compressor portion in the first embodiment taken along a line B-B in FIG. 3.
Figure 5:
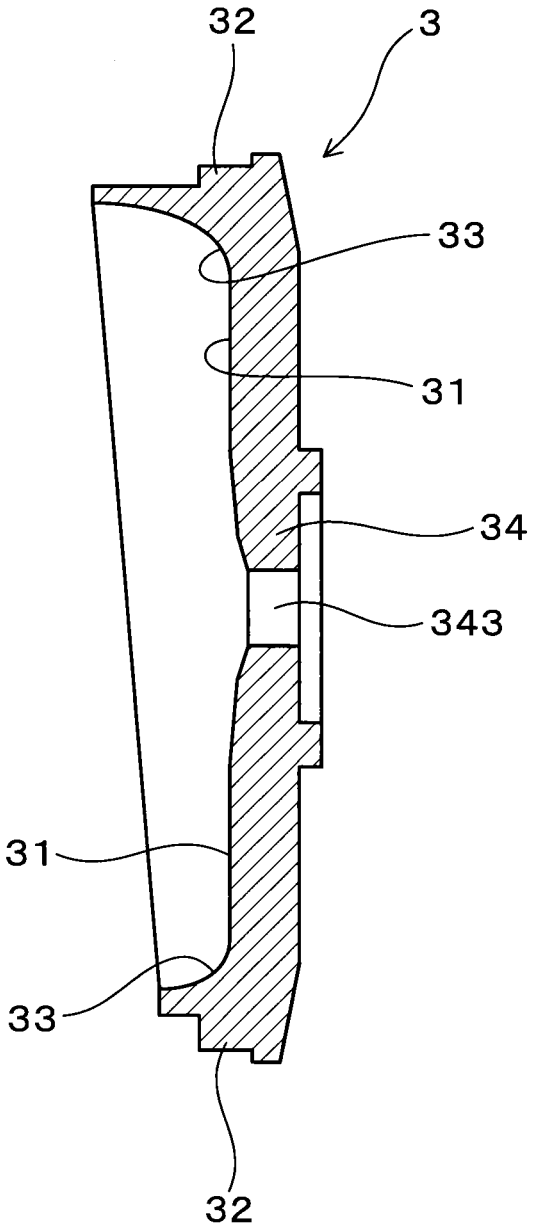
FIG. 5 is a sectional view of a back plate in the first embodiment.

As shown in FIGS. 1, 2 and 5, the back plate 3 includes a facing surface 31 which is facing to the diffuser surface 54, an outer peripheral annular fit-in portion 32 which is fitted into the scroll outer periphery 43 of the scroll piece 4, and an outer peripheral concave surface 33 configuring an outer peripheral wall surface of the discharge scroll chamber 12.

As shown in FIGS. 1, 2, 10 and 11, the outer peripheral concave surface 33 has such a shape that a cross sectional shape thereof formed by a plane including a rotation axis of the impeller 13 (when it is merely mentioned "cross sectional shape" in the following description, this means a cross sectional shape formed by this plane unless otherwise specified) gradually changes along the circumferential direction.

More specifically, the cross sectional shape of the outer peripheral concave surface 33 is formed such that a radius of curvature of the outer peripheral concave surface 33 gradually increases as approaching the discharge port 15 in the circumferential direction.

Figures 11A, 11B, 11C, 11D:
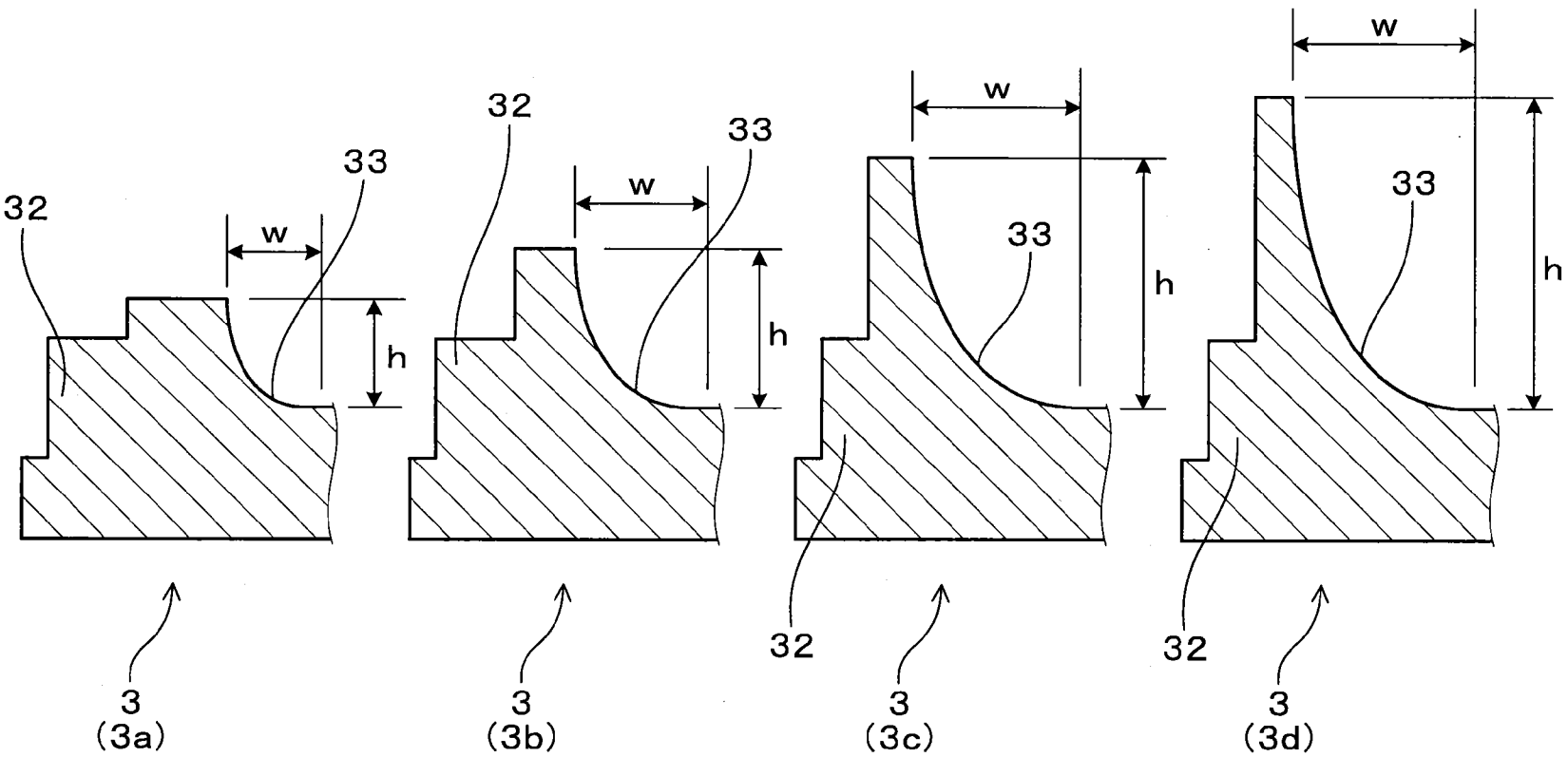
FIG. 11A is a sectional view taken along a line C-C in FIG. 10.
FIG. 11B is a sectional view taken along line D-D in FIG. 10.
FIG. 11C is a sectional view taken along line E-E in FIG. 10.
FIG. 11D is a sectional view taken along line F-F in FIG. 10.

An axial size h of the outer peripheral concave surface 33 gradually becomes larger toward the discharge port 15 in the circumferential direction. A radial size w of the outer peripheral concave surface 33 also becomes larger toward the discharge port 15 in the circumferential direction. Symbols 3*a*, 3*b*, 3*c* and 3*d* in FIGS. 11A, 11B, 11C and 11D show cross sections of portions of the back plate 3 at positions further, in this order, from the discharge port 15 as a passage of compressed air. That is, the symbols 3*a*, 3*b*, 3*c* and 3*d* in FIG. 11 show cross sections of the portions of the back plate 3 forming parts of cross sections 12*a*, 12*b*, 12*c* and 12*d* of the discharge scroll chamber 12 shown in FIGS. 1 and 2.

As shown in FIGS. 1 and 2, a cross sectional shape of the suction-side concave surface 42 of the scroll piece 4 gradually changes along the circumferential direction. A cross sectional shape of the inner peripheral concave surface 52 of the shroud piece 5 also gradually changes along the circumferential direction. The cross sectional shapes of the suction-side concave surface 42 and the inner peripheral concave surface 52 are formed such that radii of curvature thereof gradually become larger toward the discharge port 15 in the circumferential direction.

In the turbocharger 1, a turbine is rotated by exhaust gas discharged from an internal combustion engine of a car or the like, suction air is compressed in a compressor utilizing this rotation force, and the compressed air is sent from the discharge port 15 into the internal combustion engine. Therefore, the turbocharger 1 is provided with a turbine housing (not shown) on a side opposite, in the axial direction, to the compressor housing 2 which configures an outer shell of the compressor. An exhaust gas flow passage is formed inside of the turbine housing, and a turbine impeller is disposed in the exhaust gas flow passage. The turbine impeller is fixed to the rotor shaft 14. That is, the impeller 13 of the compressor and the turbine impeller are connected to each other through the rotor shaft 14. According to this, as the turbine impeller rotates, the impeller 13 of the compressor rotates.

The bearing housing 6 rotatably supports the rotor shaft 14. The bearing housing 6 is disposed between the compressor housing 2 and the turbine housing. As shown in FIGS. 1, 2, 8 and 9, the substantially disk-shaped back plate 3 is fixed to one end of the bearing housing 6 in the axial direction.

The back plate 3 is fastened to the bearing housing 6 through a bolt (not shown). As shown in FIGS. 5 and 8 to 10, a shaft hole 341 through which the rotor shaft 14 is inserted, bolt holes 342 through which bolts are inserted, and an oil discharge port 343 through which lubricant is discharged are formed in a plate central portion 34 of the back plate 3. The plate central portion 34 is located on an inner peripheral side thereof as compared with the facing surface 31.

Figure 9:
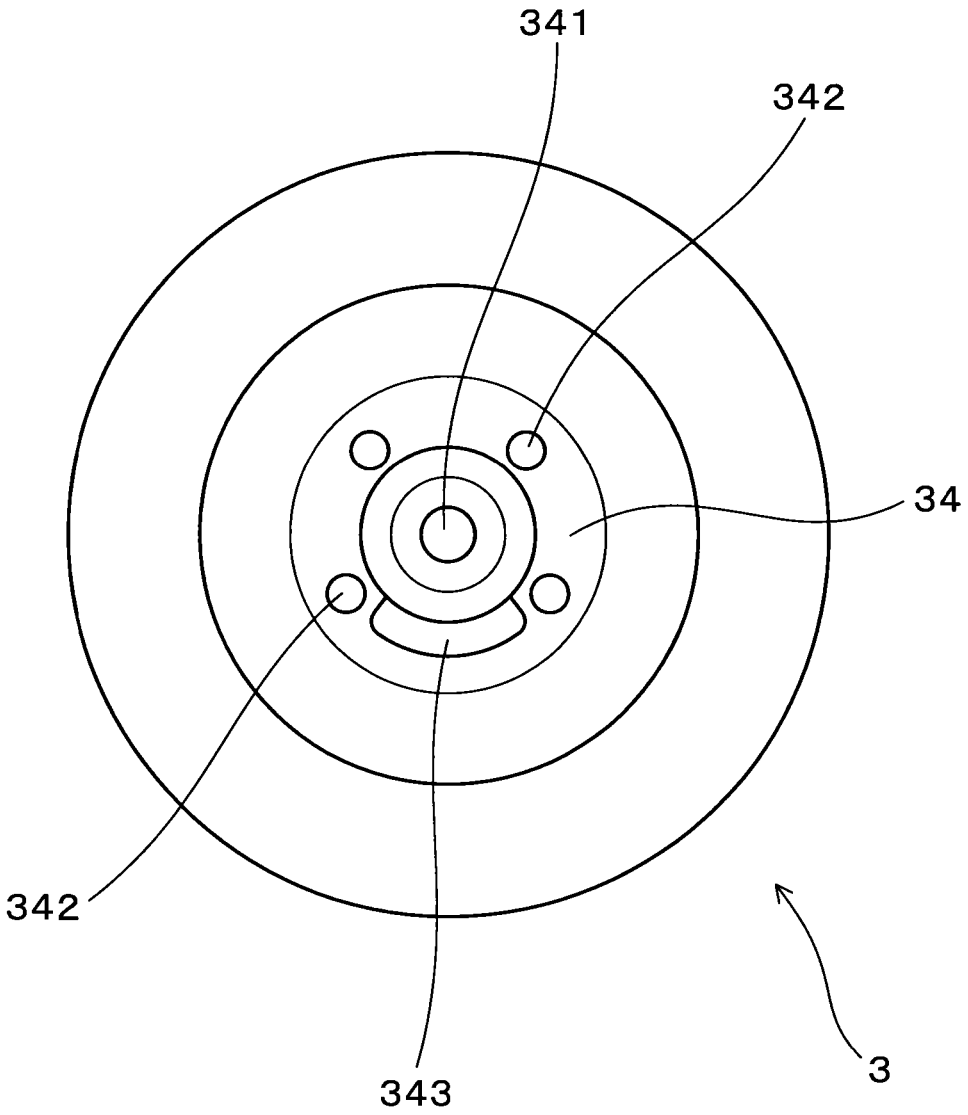
FIG. 9 is a rear view of the back plate in the first embodiment as viewed from a bearing housing.

In this embodiment, four bolt holes 342 are formed, and the one oil discharge port 343 is formed. As shown in FIG. 9, the oil discharge port 343 is disposed in a surface of the back plate 3 on the side of the bearing housing 6 between two of the bolt holes 342 which are adjacent to each other in the circumferential direction. The oil discharge port 343 is dented in a thickness direction of the back plate 3, and the oil discharge port 343 guides lubricant which drips from the shaft hole 341 into an oil discharge passage (not shown) in the bearing housing 6.

Figure 8:
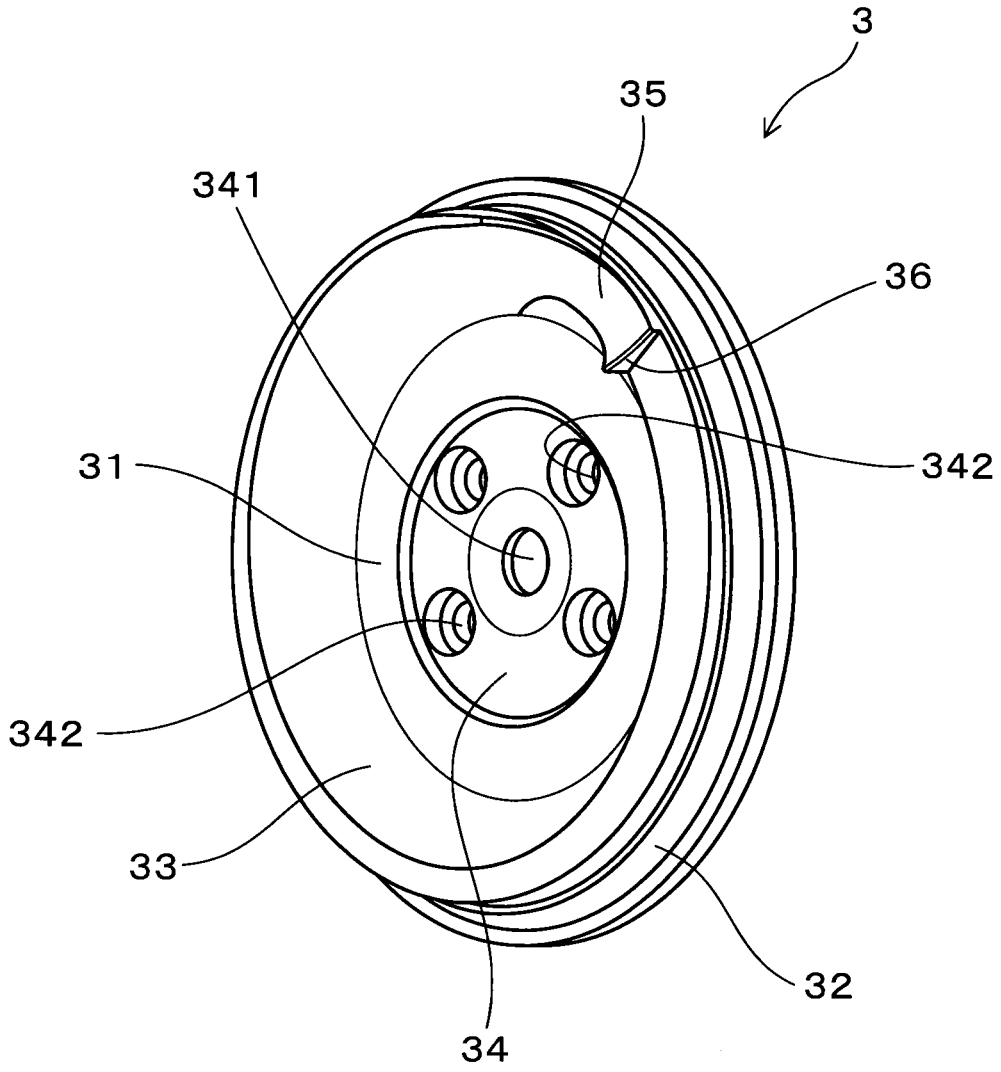
FIG. 8 is a perspective view of the back plate in the first embodiment.
Figure 10:
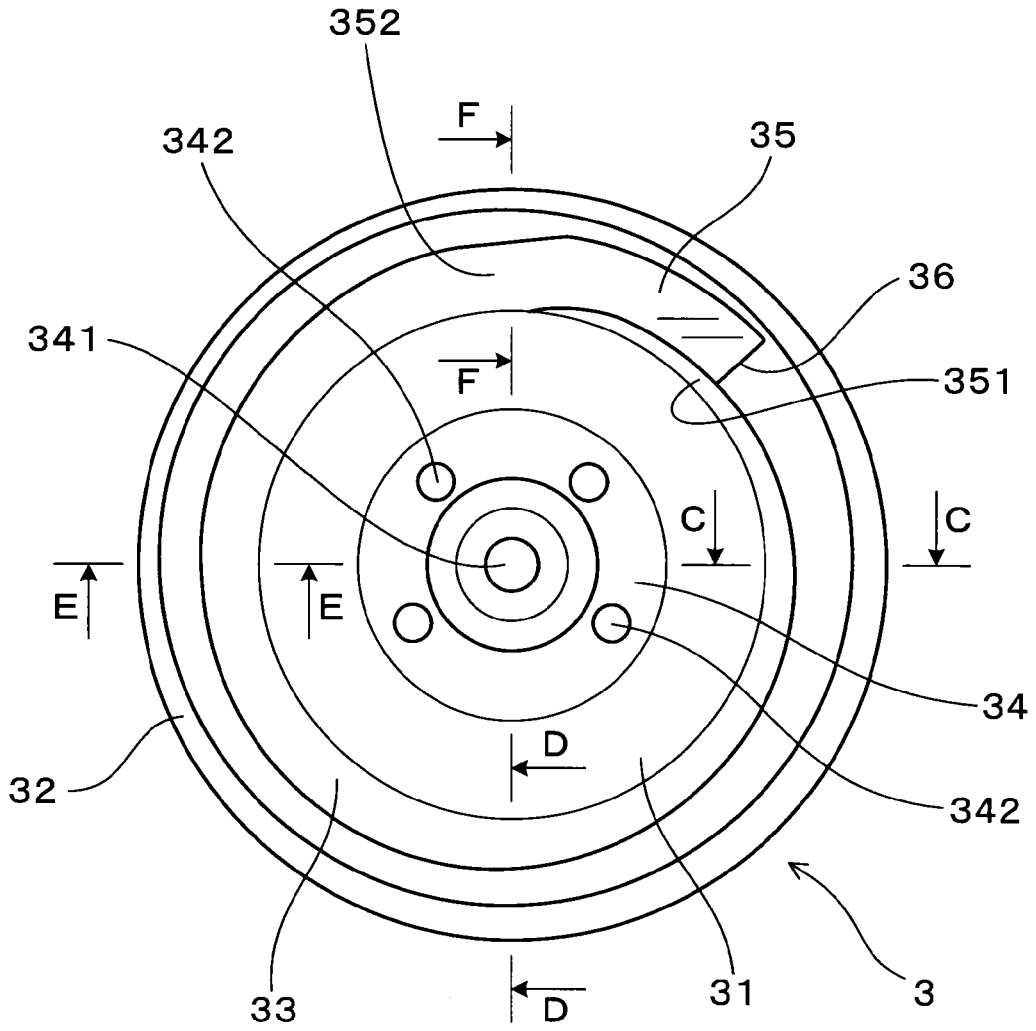
FIG. 10 is a front view of the back plate in the first embodiment as viewed from a compressor.

As shown in FIGS. 8 and 10, the facing surface 31 and the outer peripheral concave surface 33 are annularly formed on a surface of the back plate 3 on the side of the compressor. As shown in FIG. 5, the facing surface 31 and the outer peripheral concave surface 33 are mutually continuously formed. That is, the facing surface 31 is formed as a flat surface intersecting with the axial direction at right angles, but the outer peripheral concave surface 33 is formed such that it curves, toward the compressor, from an outer peripheral end of the facing surface 31 continuously without through a step or the like. As described above, the cross sectional shape of the outer peripheral concave surface 33 gradually changes in the circumferential direction.

The discharge scroll chamber 12 is formed by the outer peripheral concave surface 33 of the back plate 3 formed as described above, the scroll outer periphery 43 of the scroll piece 4 formed such that its cross sectional shape gradually changes in the circumferential direction, and the inner peripheral concave surface 52 of the shroud piece 5 (FIGS. 1 and 2).

As shown in FIG. 6, the discharge scroll chamber 12 is substantially annularly formed, and the discharge port 15 projects from the discharge scroll chamber 12 in a tangential direction of the circumferential direction. Across-sectional area of the discharge scroll chamber 12 gradually increases toward the discharge port 15 along the circumferential direction. Symbols 12*a*, 12*b*, 12*c* and 12*d* in FIGS. 1 and 2 show cross sections of the discharge scroll chamber 12 at positions further, in this order, from the discharge port 15 as a passage of compressed air.

Hence, cross sectional shapes of the suction-side concave surface 42 of the scroll piece 4, the inner peripheral concave surface 52 of the shroud piece 5 and the outer peripheral concave surface 33 of the back plate 3 which form the discharge scroll chamber 12 gradually change not rotation symmetrically but along the circumferential direction. As shown in FIGS. 1, 2, 10 and 11, the back plate 3 has such a shape that a size (size h in axial direction and size w in radial direction) of the cross sectional shape of the outer peripheral concave surface 33 and an average radius of curvature gradually increase in the circumferential direction. That is, the sizes h and w and the average radius of curvature increase in the circumferential direction and toward the discharge port 15.

As shown in FIG. 10, a discharge communication concave portion 35 is formed in a circumferential part of the back plate 3. The discharge communication concave portion 35 connects the discharge scroll chamber 12 and the discharge port 15 to each other. The discharge communication concave portion 35 is formed so as to be parallel to the discharge port 15 between a portion of the outer peripheral concave surface 33 where the axial size h is the largest and a portion of the outer peripheral concave surface 33 where the axial size h is the smallest. That is, the sizes h and w and the radius of curvature of the outer peripheral concave surface 33 gradually increase in the circumferential direction from a first adjacent portion 351 to a second adjacent portion 352 with respect to the discharge communication concave portion 35 shown in FIG. 10 over a substantially entire circumference of the back plate 3 except a portion thereof where the discharge communication concave portion 35 is formed.

Further, as shown in FIGS. 8 and 10, a positioning step 36 for positioning the back plate 3 and the compressor housing 2 in the circumferential direction is formed on an outer peripheral side of the outer peripheral concave surface 33 and at a position adjacent to the discharge communication concave portion 35 in the circumferential direction. That is, as show in FIG. 7, a positioning step 46 is formed also on the compressor housing 2 at a position corresponding to the positioning step 36 of the back plate 3.

Figure 4:
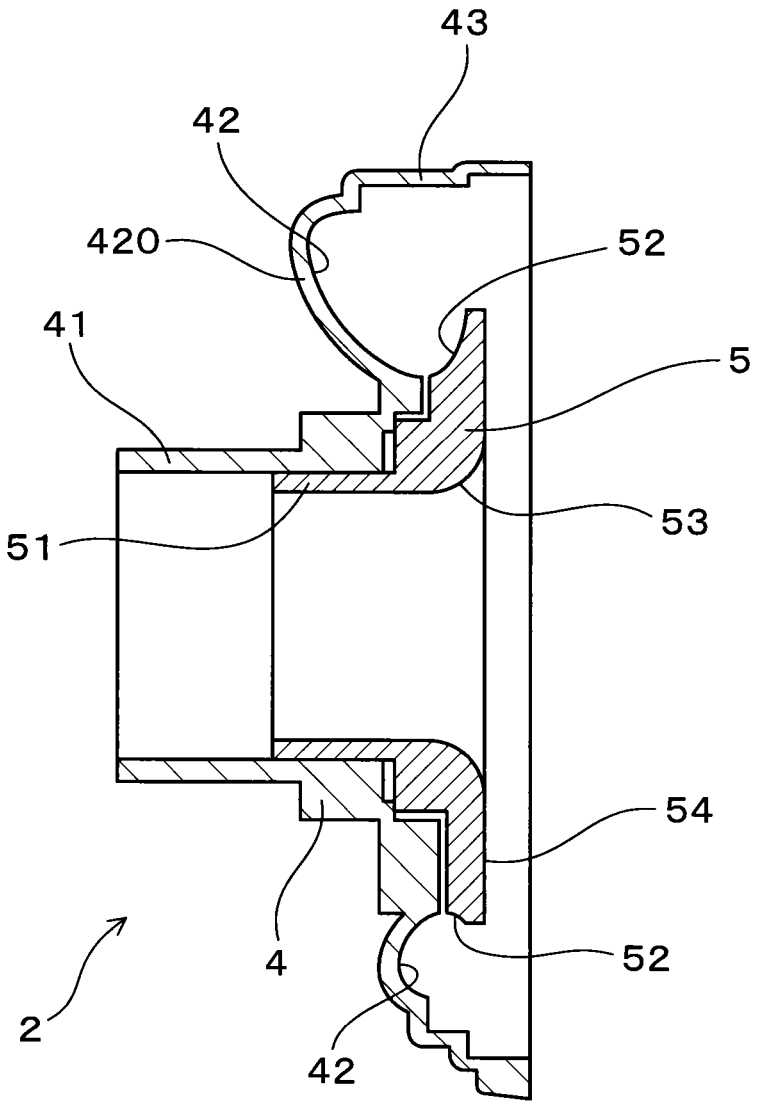
FIG. 4 is a sectional view of the compressor housing in the first embodiment.

The scroll piece 4 and the shroud piece 5 configuring the compressor housing 2 are formed of aluminum die casted articles. As shown in FIG. 4, the suction port-forming portion 41 of the scroll piece 4 is formed into a cylindrical shape centering around a rotation axis of the impeller 13. A scroll wall surface-forming portion 420 having the suction-side concave surface 42 is formed from an end of the suction port-forming portion 41 on a side opposite to the suction side (suction side is called "tip end side" and its opposite side is called "base end side" hereinafter) such as to spread toward the outer peripheral side. The scroll outer periphery 43 is provided on an outer peripheral portion of the scroll wall surface-forming portion 420 such as to extend to the base end side.

The shroud fit-in portion 51 of the shroud piece 5 is formed into a cylindrical shape centering around the rotation axis of the impeller 13, and a suction passage which is in communication with the suction port 11 is formed in the shroud fit-in portion 51. The shroud fit-in portion 51 is fitted into the suction port-forming portion 41 of the scroll piece 4.

An inner surface of the shroud fit-in portion 51 is formed such that it spreads outward from the base end side, thereby forming the shroud surface 53. The shroud surface 53 is connected to the diffuser surface 54 which spreads in a direction intersecting with the axial direction at right angles on its outer peripheral side.

As shown in FIGS. 1 and 2, the impeller 13 is disposed on the inner peripheral side of the shroud piece 5. The impeller 13 is formed by projecting a plurality of blades which are arranged in the circumferential direction from an outer peripheral surface of a hub. The blades are facing to the shroud surface 53 of the shroud piece 5.

Figure 7:
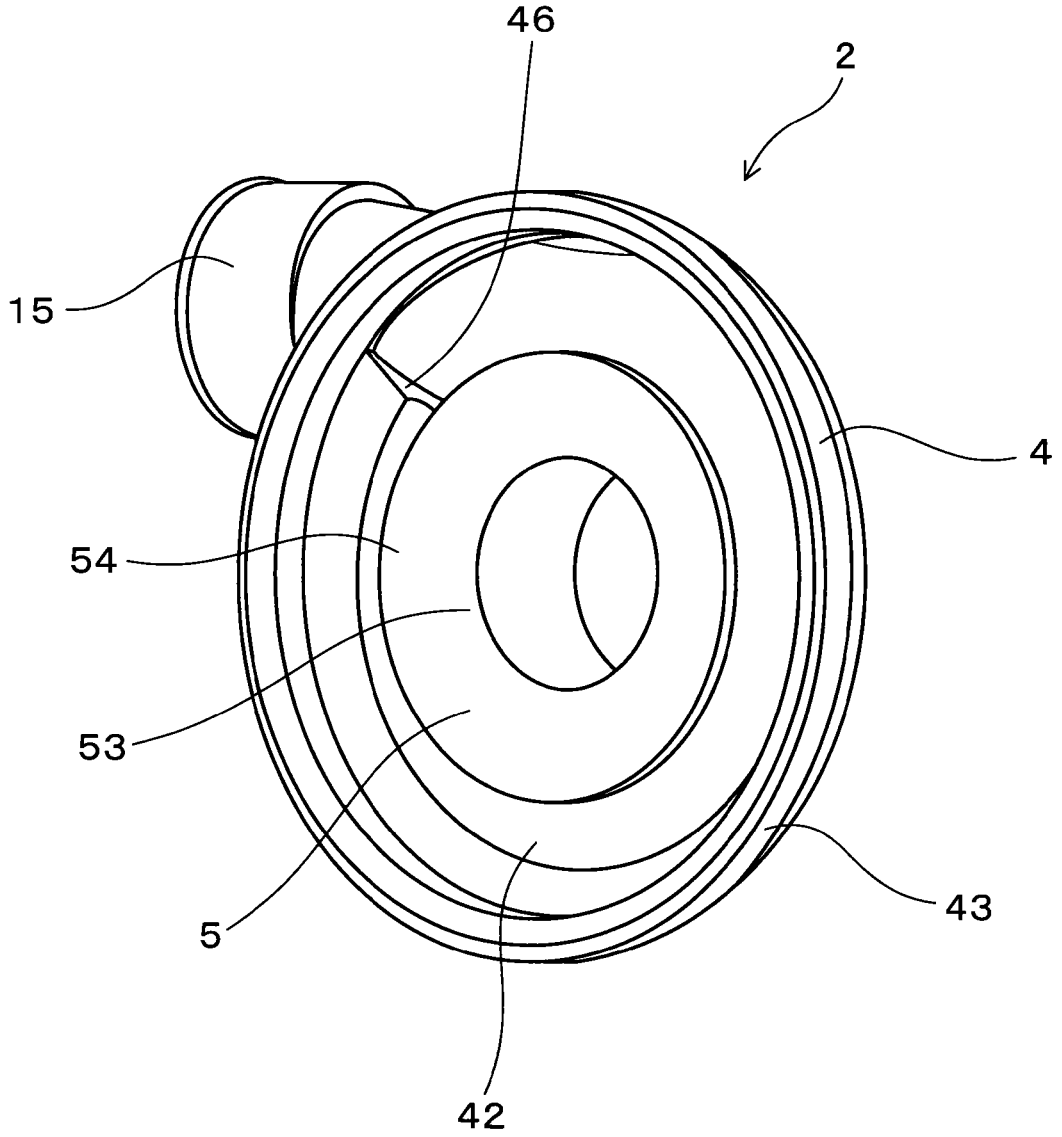
FIG. 7 is a perspective view of the compressor housing in the first embodiment.

When a compressor portion of the turbocharger 1 is assembled, the shroud fit-in portion 51 is press-fitted into the suction port-forming portion 41, thereby assembling the shroud piece 5 into the scroll piece 4, and the compressor housing 2 shown in FIGS. 4 and 7 is formed. The back plate 3 is fastened to the bearing housing 6 and fixed thereto.

Thereafter, the compressor housing 2 is assembled to the back plate 3. That is, as shown in FIGS. 1 and 2, the compressor housing 2 is assembled to the back plate 3 which is fixed to the bearing housing 6 such that the impeller 13 is disposed inside of the compressor housing 2. At this time, the outer peripheral annular fit-in portion 32 in the back plate 3 is press-fitted into the scroll outer periphery 43 in the scroll piece 4.

At this time, the positioning step 46 of the scroll piece 4 is abutted against the positioning step 36 of the back plate 3 in the circumferential direction, thereby positioning, in the circumferential direction, the back plate 3 and the compressor housing 2.

According to this, the diffuser surface 54 of the shroud piece 5 and the facing surface 31 of the back plate 3 are facing to each other at a predetermined distance from each other, and a diffuser portion 16 is formed therebetween. On the outer peripheral side of the diffuser portion 16, the discharge scroll chamber 12 is formed by the suction-side concave surface 42 of the scroll piece 4, the inner peripheral concave surface 52 of the shroud piece 5 and the outer peripheral concave surface 33 of the back plate 3.

The back plate 3 is also formed of aluminum die casted articles.

Figure 12:
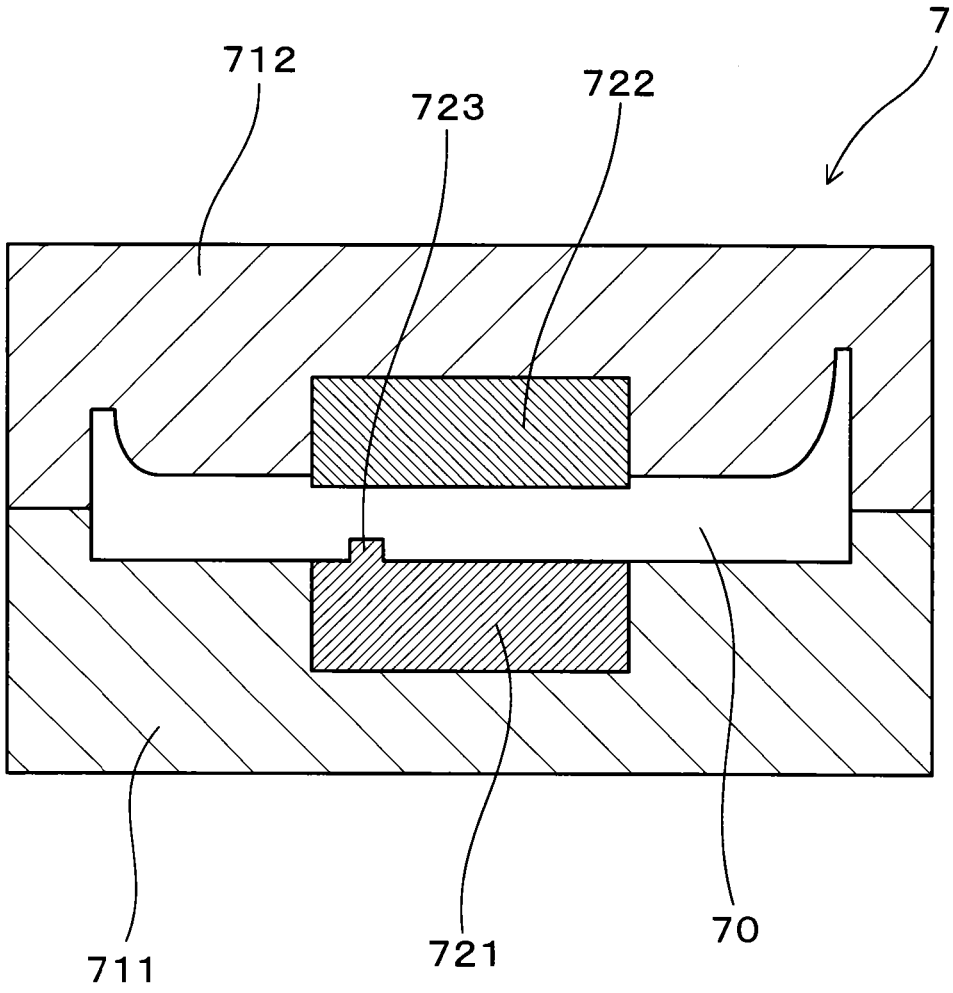
FIG. 12 is a sectional view of a mold in the first embodiment.
Figure 13A:
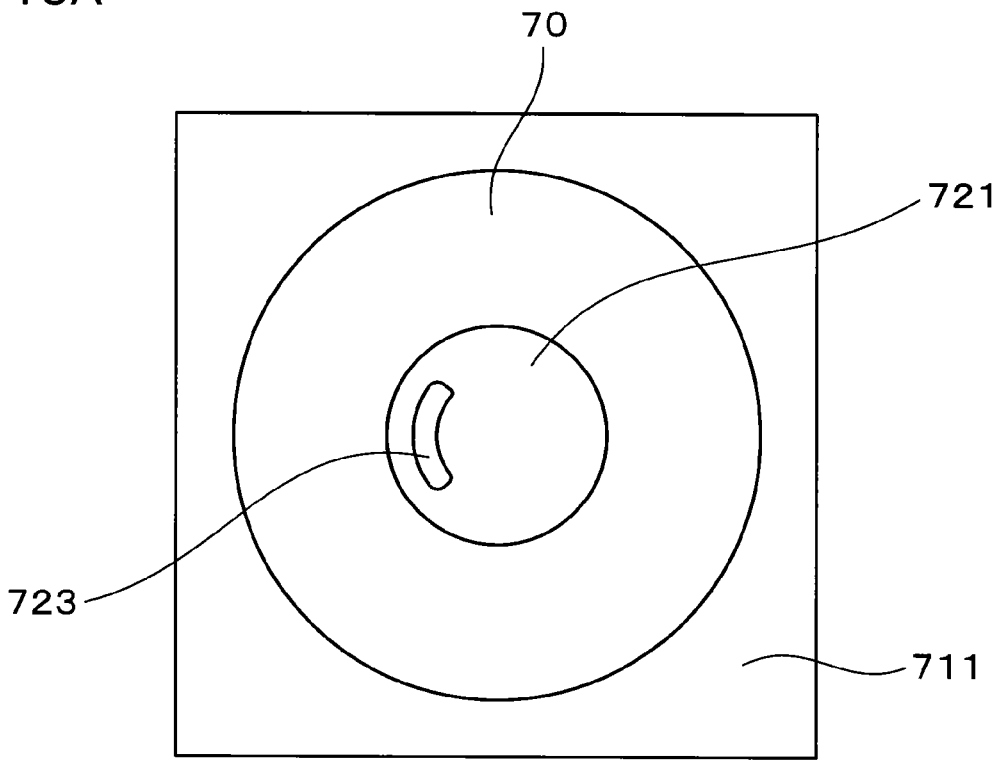
FIG. 13A is a plan view of a mold (lower mold) in which a central mold is attached to a body mold.
Figure 13B:
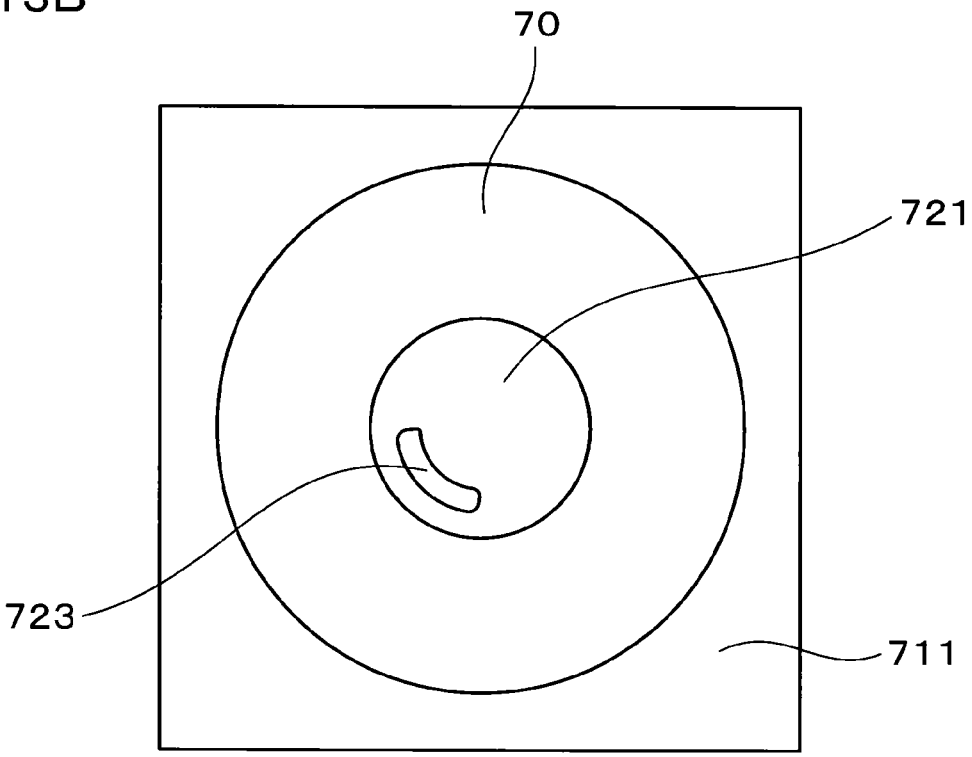
FIG. 13B is a plan view of the mold (lower mold) in which the central mold is attached to the body mold with a phase which is different from that of FIG. 13A in the first embodiment.

As shown in FIG. 12, a mold 7 used when the back plate 3 is casted includes body molds 711 and 712 for forming the facing surface 31, the outer peripheral annular fit-in portion 32 and the outer peripheral concave surface 33, and central molds 721 and 722 for forming the plate central portion 34, and the central molds 721 and 722 are detachably attached to the body molds 711 and 712. As shown in FIGS. 13A and 13B, the central molds 721 and 722 can be attached such that their phases in the circumferential direction can be changed with respect to the body molds 711 and 712.

The mold 7 includes a cavity 70 between a lower mold formed by attaching the central mold 721 to the body mold 711 and an upper mold formed by attaching the central mold 722 to the body mold 712.

A mold surface for forming a surface of the back plate 3 on the side of the bearing housing 6 is formed on the lower mold (body mold 711 and central mold 721). A mold surface for forming a surface of the back plate 3 on the side of the compressor housing 2 is formed on the upper mold (body mold 712 and central mold 722). The mold surface of the central mold 721 has a projection 723 for forming the oil discharge port 343. Various convex and concave shapes are formed on the central molds 721 and 722 in addition to the projection 723 but these convex and concave shapes are omitted in FIG. 12. Illustration of the mold surfaces of the body molds 711 and 712 are also simplified.

As shown in FIG. 13, the central mold 721 as viewed from a normal direction of the mold surface is circular in shape. According to this, the central mold 721 can be attached to the body mold 711 from any orientation in the circumferential direction. The central mold 722 as viewed from a normal direction of the mold surface is also circular in shape, and the central mold 722 can be attached to the body mold 712 from any orientation in the circumferential direction.

Hence, if an attaching orientation of the central mold 721 (722) with respect to the body mold 711 (712) is changed between a state shown in FIG. 13A and a state shown in FIG. 13B and back plates 3 are die casted, different kinds of back plates 3 can be obtained. Here, the different kinds of back plates 3 mean back plates 3 having phase difference (positional relation in circumferential direction) differ between the plate central portion 34 (oil discharge port 343) and the outer peripheral concave surface 33 (positioning step 36).

This embodiment has the following advantageous effects.

In the turbocharger 1, since the compressor housing 2 can be configured using the two pieces, i.e., the scroll piece 4 and the shroud piece 5, the number of parts of the compressor housing 2 can be relatively small. As a result, the producing man-hours of the turbocharger 1 can be reduced and the producing costs can be reduced.

Further, apart of the wall surface of the discharge scroll chamber 12 can be formed by the outer peripheral concave surface 33 of the back plate 3. That is, in a turbocharger in which a back plate is disposed between a bearing housing and a compressor housing, a part of the wall surface of a discharge scroll chamber 12 is formed into a concave shape utilizing a part of the back plate 3 which is an existing part. Hence, it is possible to enhance flexibility in shape of the discharge scroll chamber 12 without increasing the number of parts.

The outer peripheral concave surface 33 has such a shape that its cross sectional shape gradually changes along the circumferential direction. Hence, the shape of the wall surface of the discharge scroll chamber 12 on the outer peripheral side can gradually be changed along the circumferential direction. According to this, the discharge scroll chamber 12 can be formed into an ideal shape, and it is possible to realize ideal air flow in the compressor. As a result, it is possible to enhance performance of the turbocharger 1.

The outer peripheral concave surface 33 is formed in the back plate 3 together with a facing surface 31. Hence, a seam is not formed between the facing surface 31 and the outer peripheral concave surface 33. Therefore, it is possible to easily and reliably realize a smooth flow of compressed air which is discharged from a diffuser portion 16 into the discharge scroll chamber 12. From this point of view also, it is possible to enhance the performance of the turbocharger 1.

The cross sectional shape of the outer peripheral concave surface 33 is formed such that the radius of curvature thereof gradually increases and the size h in the axial direction and the size w in the radial direction gradually increase toward the discharge port 15 in the circumferential direction. According to this, the discharge scroll chamber 12 can more easily be formed into the ideal shape. That is, the outer peripheral concave surface 33 configuring a part of the wall surface of the discharge scroll chamber 12 has the above-described shape. According to this, the discharge scroll chamber 12 has such a shape that its cross-sectional area gradually increases toward the discharge port 15 in the circumferential direction, and it becomes easy to form the cross sectional shapes of various portions of the discharge scroll chamber 12 into ideal shapes.

The shaft hole 341, the bolt holes 342 and the oil discharge port 343 are formed in the plate central portion 34 of the back plate 3. According to this, when the back plate 3 is produced, if its accuracy is enhanced, it is possible to easily assemble the turbocharger 1 while keeping the positional accuracy of the outer peripheral concave surface 33 in the circumferential direction. That is, if the back plate 3 is produced such that a positional relation (phase difference) in the circumferential direction between a position of the bolt holes 342 and a shape of the outer peripheral concave surface becomes a predetermined positional relation (phase difference), a position of the outer peripheral concave surface 33 is determined by fastening a bolt to the back plate 3 through the bolt holes 342 and fixing the back plate 3 to the bearing housing 6. If a circumferential position is aligned to the outer peripheral concave surface 33 and the compressor housing 2 is fitted to the back plate 3, the discharge port 15 can be disposed at a position as designed, i.e., at a position corresponding to a position of a pipe to be connected. That is, the positioning step 46 of the scroll piece 4 is abutted against the positioning step 36 of the back plate 3 in the circumferential direction, and the compressor housing 2 is assembled to the back plate 3. According to this, an accurate discharge scroll chamber 12 can be formed by the outer peripheral concave surface 33 and the suction-side concave surface 42, and the discharge port 15 can be directed to an appropriate direction. As described above, when the turbocharger 1 is assembled, it is possible to easily dispose the discharge scroll chamber 12 and the discharge port 15 at appropriate circumferential positions.

In the above producing method, the back plate 3 is casted using the mold 7 in which the central molds 721 and 722 are detachably attached to the body molds 711 and 712. The central molds 721 and 722 can be attached to the body molds 711 and 712 such that the phases of the central molds 721 and 722 can be changed in the circumferential direction with respect to the body molds 711 and 712. Hence, the back plate 3 can be produced while appropriately changing the phase of the outer peripheral concave surface 33 with respect to the plate central portion 34. The phase of the plate central portion 34 when it is assembled into the turbocharger 1 is determined by necessity by the position of the oil discharge port 343. Although the phase of the outer peripheral concave surface 33 is set in accordance with the position of the discharge port 15, the position differs depending upon a type of a vehicle or the like in which the turbocharger 1 is to be mounted. Thus, a phase difference between the plate central portion 34 and the outer peripheral concave surface 33 in the circumferential direction differs depending upon a corresponding vehicle type. Therefore, since the mold 7 for casting the back plate 3 is configured such that the central molds 721 and 722 can be attached to the body molds 711 and 712 with the phases of the central molds 721 and 722 changed in the circumferential direction with respect to the body molds 711 and 712, a plurality of kinds of back plates 3 suitable for corresponding vehicle types can be produced using one kind of mold 7. Hence, according to the producing method, it is possible to produce a plurality of kinds of back plates 3 with excellent production efficiency, and the production efficiency of the turbocharger 1 can be enhanced.

As described above, according to this embodiment, it is possible to provide a turbocharger capable of reducing its costs and enhancing its performance, and to provide a method of producing the turbocharger.

Although the scroll piece and the shroud piece are made of aluminum by die casting in the embodiment, a material and a producing method of these pieces are not limited to these, and these pieces can be made of other material and by other producing method. For example, the shroud piece may be a resin molded article.

Although the back plate is also made of aluminum by die casting in the embodiment, a material and a producing method of the back plate are not limited to these.

In the mold shown in the embodiment, it is not necessary that the central molds are attached to both the upper and lower molds. That is, the central mold may be detachably attached to only the lower mold or the upper mold.

What is claimed is:

1. A turbocharger comprising:

a compressor housing provided therein with an air flow passage in which an impeller is disposed;

a bearing housing rotatably supporting a rotor shaft which is connected to the impeller; and a back plate which is disposed between the bearing housing and the compressor housing and which faces a part of the air flow passage, wherein the air flow passage includes a suction port from which air is sucked toward the impeller, and a discharge scroll chamber which is formed on an outer peripheral side of the impeller in a circumferential direction, and which guides compressed air discharged from the impeller to a discharge port, the discharge scroll chamber has such a shape that a cross sectional area thereof gradually increases toward the discharge port in the circumferential direction, the compressor housing includes a scroll piece and a shroud piece which are mutually assembled, the scroll piece includes a cylindrical suction port-forming portion forming the suction port, a suction-side concave surface configuring a suction-side wall surface of the discharge scroll chamber, and a scroll outer periphery disposed on an outer peripheral side of the discharge scroll chamber, the shroud piece includes a cylindrical shroud fit-in portion which is fitted into the scroll piece, an inner peripheral concave surface configuring an inner peripheral wall surface of the discharge scroll chamber, a shroud surface facing to the impeller, and a diffuser surface extending from the shroud surface toward the discharge scroll chamber, the back plate includes a facing surface which is facing to the diffuser surface, an outer peripheral annular fit-in portion which is fitted into the scroll outer periphery of the scroll piece, and an outer peripheral concave surface configuring an outer peripheral wall surface of the discharge scroll chamber, and the outer peripheral concave surface has such a shape that a cross sectional shape thereof formed by a plane including a rotation axis of the impeller gradually changes along the circumferential direction, wherein the back plate is fastened to the bearing housing through a bolt, a shaft hole through which the rotor shaft is inserted, a bolt hole through which the bolt is inserted and an oil discharge port through which lubricant is discharged are formed in a plate central portion of the back plate on an inner peripheral side thereof as compared with the facing surface, and wherein the oil discharge port is dented in a thickness direction of the back plate from a side of the bearing housing.

2. The turbocharger according to claim 1, wherein the cross sectional shape of the outer peripheral concave surface is formed such that a radius of curvature thereof gradually increases toward the discharge port in the circumferential direction.

3. The turbocharger according to claim 1, wherein the outer peripheral concave surface is formed such that a size thereof in an axial direction of the turbocharger gradually increases from its one end toward the other end in the circumferential direction.

4. The turbocharger according to claim 1, wherein the outer peripheral concave surface is formed such that a size thereof in a radial direction gradually increases toward the discharge port in the circumferential direction.

5. A method of producing the turbocharger according to claim 1, in which the scroll piece, the shroud piece and the back plate are individually casted, the scroll piece and the shroud piece are assembled to each other to obtain the compressor housing, the back plate is fastened to the bearing housing, and the compressor housing is assembled to the back plate to produce the turbocharger, wherein a mold to cast the back plate includes a body mold to form the facing surface, the outer peripheral annular fit-in portion and the outer peripheral concave surface, and a central mold to form the plate central portion, the central mold is detachably attached to the body mold, and the central mold is attached to the body mold such that a circumferential phase of the central mold is changed with respect to the body mold.

6. The turbocharger according to claim 1, wherein the oil discharge port is disposed between a pair of the bolt holes in the circumferential direction.

* * * * *